US012760934B2

(12) United States Patent
Chauhan et al.

(10) Patent No.: US 12,760,934 B2
(45) Date of Patent: Oct. 13, 2026

(54) SYSTEM AND METHOD OF ENERGY EFFICIENT HOT AND COLD WATER MANAGEMENT

(71) Applicants: Urvi Chauhan, Haridwar (IN); Rudra Pratap Singh Chauhan, Haridwar (IN); Jagdeep Ravindra Kumar, Haridwar (IN)

(72) Inventors: Urvi Chauhan, Haridwar (IN); Rudra Pratap Singh Chauhan, Haridwar (IN); Jagdeep Ravindra Kumar, Haridwar (IN)

( * ) Notice: Subject to any disclaimer, the term of this patent is extended or adjusted under 35 U.S.C. 154(b) by 15 days.

(21) Appl. No.: 17/787,422

(22) PCT Filed: Dec. 21, 2020

(86) PCT No.: PCT/IN2020/051038
§ 371 (c)(1),
(2) Date: Jun. 20, 2022

(87) PCT Pub. No.: WO2021/124358
PCT Pub. Date: Jun. 24, 2021

(65) Prior Publication Data

US 2023/0017924 A1 Jan. 19, 2023

(30) Foreign Application Priority Data

Dec. 19, 2019 (IN) ..... 201911052747

(51) Int. Cl.
*F24H 15/223* (2022.01)
*F24D 17/00* (2022.01)
(Continued)

(52) U.S. Cl.
CPC ..... *F24H 15/223* (2022.01); *F24D 17/0031* (2013.01); *F24D 19/1051* (2013.01);
(Continued)

(58) Field of Classification Search
CPC .... F24H 15/305; F24H 15/223; F24H 15/355; F24H 15/31; F24H 15/262; F24H 15/248;
(Continued)

(56) References Cited

U.S. PATENT DOCUMENTS 4,839,057 A * 6/1989 White ..... C02F 1/5281 210/667
4,901,915 A * 2/1990 Sakakibara ..... G05D 23/1393 236/46 F (Continued)

*Primary Examiner* — Steven B McAllister
*Assistant Examiner* — John E Bargero

(57) ABSTRACT

Disclosed are system 100 and method of energy efficient hot and cold water management. The system 100 comprises: a control unit 101 for dynamically controlling the functioning of the system 100; at least a water storage tank 102 with at least one of a water level sensor, at least a heating element 1021, at least a temperature sensor 1022 or any combination thereof; at least an auxiliary water storage tank 103 with at least one of a water level sensor, at least a temperature sensor 1032; at least a water mixer unit 105 having at least a temperature sensor 1051; a user interface unit 1012 for controlling and monitoring different parameters including temperature, water level, opening and closing of valves 108 and 109; and a power supply with power backup unit 104 for providing basic power for proper functioning of the system 100.

11 Claims, 6 Drawing Sheets

(51) Int. Cl.

| | |
|---|---|
| ***F24D 19/10*** | (2006.01) |
| ***F24H 15/156*** | (2022.01) |
| ***F24H 15/174*** | (2022.01) |
| ***F24H 15/248*** | (2022.01) |
| ***F24H 15/262*** | (2022.01) |
| ***F24H 15/269*** | (2022.01) |
| ***F24H 15/281*** | (2022.01) |
| ***F24H 15/305*** | (2022.01) |
| ***F24H 15/31*** | (2022.01) |
| ***F24H 15/355*** | (2022.01) |
| ***F24H 15/395*** | (2022.01) |
| *F24H 15/464* | (2022.01) |

(52) U.S. Cl.

CPC ..... *F24H 15/156* (2022.01); *F24H 15/174* (2022.01); *F24H 15/248* (2022.01); *F24H 15/262* (2022.01); *F24H 15/269* (2022.01); *F24H 15/281* (2022.01); *F24H 15/305* (2022.01); *F24H 15/31* (2022.01); *F24H 15/355* (2022.01); *F24H 15/395* (2022.01); *F24D 2220/042* (2013.01); *F24D 2220/048* (2013.01); *F24H 15/464* (2022.01)

(58) Field of Classification Search

CPC .... F24H 15/281; F24H 15/174; F24H 15/395; F24H 15/269; F24H 15/156; F24H 15/464; F24H 2250/02; F24D 17/0031; F24D 19/1051; F24D 2220/042; F24D 2220/048

USPC ..... 237/8 A

See application file for complete search history.

(56) References Cited

U.S. PATENT DOCUMENTS

| | | | | |
|---|---|---|---|---|
| 2009/0234513 | A1* | 9/2009 | Wiggins | F24H 15/414 700/300 |
| 2012/0055419 | A1* | 3/2012 | Beyerle | F24D 11/004 122/14.1 |
| 2014/0203093 | A1* | 7/2014 | Young | F24D 19/1051 237/8 A |
| 2018/0112785 | A1* | 4/2018 | Shaffer | F17D 5/02 |

* cited by examiner

SYSTEM AND METHOD OF ENERGY EFFICIENT HOT AND COLD WATER MANAGEMENT

FIELD OF THE INVENTION

The present invention relates generally to water management and water temperature control, and more specifically, to system and methods for minimizing the energy consumption by suitably heating and cooling water according to household works requirements and atmospheric temperature conditions, and providing on-device and remote monitoring and controlling of the system in efficient, economical and eco-friendly manner.

BACKGROUND OF THE INVENTION

Heating or cooling of water for household works like cooking, washing, and bathing etc., is an unavoidable task of our day-to-day life. The energy required in heating or cooling of water depends on the temperature difference between desired temperature and initial temperature of water i.e., higher the temperature difference more the energy consumption. In fact, approximately an average of 13-17% home energy consumption is spent on heating the water. This energy consumption needs to be minimized.

Storage water heaters (Geysers) are used to supply hot water for household works. Generally, the conventional storage geysers available in the market provide very hot water up to 60° C.-70° C. The storage geyser consists of a water tank and heating element fitted with two pipes—one for inlet of very cold water from the outer water storage tank and the other for outlet of very hot water. This very hot water is further mixed with very cold water from outer water storage tank whose temperature is considerably very low during winter. In this case more amount of very hot water, e.g., 60° C.-70° C., from the storage geyser is needed due to mixing of very cold water, e.g., generally less than 10° C. in winters, from outer water storage tank to achieve 30° C.-35° C. warm water suitable for household works. As, the water in outer water storage tank becomes very cold, less than 10° C. or even less than 2-3° C. during extreme winter, the conventional storage geyser-limit the warm water supply and also consume more energy to heat this very cold water because higher the temperature difference more the energy consumption.

The water inlet of geysers is directly connected through outer water storage tank and the flow of water from outer water storage tank to geyser is due to gravity without any electronic control valve. The cold water from outer water storage tank automatically refills the geyser when hot water is drawn from it, which rapidly reduces the temperature of hot water in the geyser. Accordingly, the conventional geysers consume more energy to heat the water up to 60-70° C., thus reducing the overall efficiency of the system. Further, the temperature of water available at geyser outlet is approximately 60° C. to 70° C. which is harmful if it comes directly in contact with the skin, especially for children. In order to save energy, water available at inlet of geyser needs to be at room temperature.

Furthermore, during extreme hot weather, by the end of the day the water in the outer water storage tank becomes hot, which is generally not preferred by users for bathing. The available geysers have only water heating system which cannot be used in summers. Accordingly, there exists a need of geysers which have in-built cooling system.

During water purification process an alarming amount (approximately 70-75%) of water is filtered/thrown out by RO water purifiers. This water is generally treated as waste water and trickled away in wash basins or drainage. In order to utilize the water thrown by the RO water purifiers, there is also need of proper water arrangement for reuse of this water.

In view of the disadvantages inherent in the conventional water heating systems, e.g., geysers, there exists a strong need of means water conditioning and management to minimize the energy consumption in heating and cooling of water at a desired temperature and also prevent the direct contact of user with 60-70° C. hot water.

SUMMARY OF THE INVENTION

In view of the foregoing shortcomings inherent in the prior-arts, the general purpose of present invention is to provide an improved system and method to minimize the energy consumption in water conditioning i.e., heating and cooling of water as per user predefined temperature; to reuse the water wasted by RO water purifiers; to provide on-device and wireless graphical user interface for remote monitoring and controlling of the system; to include advantages of the prior art and to overcome the drawbacks inherent therein with some added advantages, in an efficient, economical and user friendly manner.

In one aspect the present invention provides a system of energy efficient hot and cold water management. The system comprises: a control unit 101 for dynamically and intelligently controlling the functioning of the system 100 by using logical and artificial intelligence; at least one of a water storage tank 102 with at least a water level sensor, at least a heating element 1021, at least a temperature sensor 1022 or any combination thereof, water storage tank 102 is capable of storing very hot water at controlled temperature; at least an auxiliary water storage tank 103 with at least one of a water level sensor and at least a temperature sensor 1032, the auxiliary water storage tank 103 used to store water from an outer water storage tank 113 which contains water at an atmospheric temperature; a power supply with power backup unit 104 for providing basic power for proper functioning of the system 100; at least a water mixer unit 105 having at least a temperature sensor 1051; a user interface unit 1012 for controlling and monitoring different parameters including temperature, water level, opening and closing of valves 108 and 109. Wherein mixing of very hot water and cold water is done either manually by a system user 112 or automatically through the control unit 101.

These together with other aspects of the present invention, along with the various features of novelty that characterized the invention, are pointed out with particularly with the claims annexed hereto and forming a part of this disclosure. For better understanding of the present invention, it's operating advantages and the specific objects attained by its uses, reference should be made to the accompanying drawing and descriptive matter in which, these are illustrated exemplary embodiments of the present invention.

BRIEF DESCRIPTION OF THE DRAWINGS

While the specification concludes with claims that particularly point out and distinctly claim the invention, it is believed that the advantages and features of the present invention will be better understood with reference to the following more detailed description of expressly disclosed exemplary embodiments taken in conjunction with the accompanying drawings. The drawings and detailed description which follow are intended to be merely illustrative of the expressly disclosed exemplary embodiments and are not intended to limit the scope of the present invention as set forth in the appended claims. In the drawings:

Like reference numerals refer to like parts throughout the several views of the drawings.

DETAIL DESCRIPTION OF THE INVENTION

Figure 1:
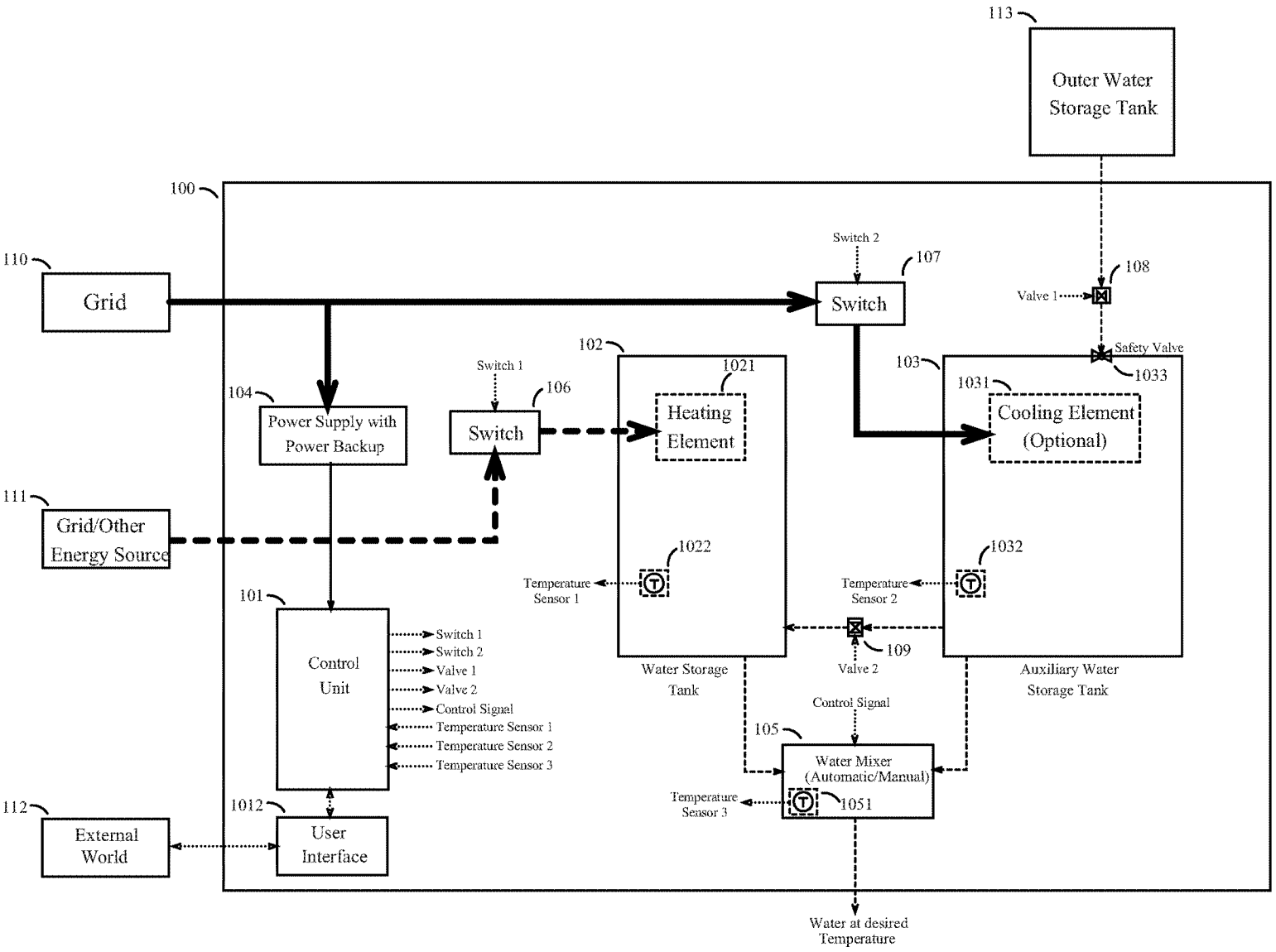
FIG. 1 is a block diagram of a system of energy efficient hot and cold water management, such that hot water is mixed with cold water either automatically or manually in water mixer, according to an exemplary embodiment of the present invention.

The exemplary embodiments described herein the details for illustrative purposes, are subject to many variations and designs. It should be emphasized, however, that the present invention is not limited to a particular system and method of energy efficient water conditioning and management as shown and described. Rather, the principles of the present invention can be used with a variety of energy efficient water conditioning and management. It is understood that various omissions, substitutions of equivalents are contemplated as circumstances may suggest or render expedient, but the present invention is intended to cover the application or implementation without departing from the spirit or scope of the its claims.

In the following description, for purposes of explanation, numerous specific details are set forth in order to provide a thorough understanding of the present invention. It will be apparent, however, to one skilled in the art that the present invention may be practiced without these specific details.

As used herein, the term 'plurality' refers to the presence of more than one of the referenced item and the terms 'a', 'an', and 'at least' do not denote a limitation of quantity, but rather denote the presence of at least one of the referenced item. The term 'water conditioning' include changing or managing the temperature of water (hot water and cold water) according to requirement. The term 'Geyser; used herein for water storage tank include in-built water heater. The term 'outer water storage tank' is used herein may include an external water supply source which provide water for an auxiliary water storage tank.

In view of minimizing the energy consumption in water conditioning i.e., heating and cooling of the water, the general purpose of the present invention is to provide system and method of energy efficient hot and cold water management, in an economical, efficient and eco-friendly manner, to minimize the energy consumption in heating water by intelligently storing water from an outer water storage tank in the auxiliary water storage tank which is further used to mix with very hot water from geyser for warm water at desired temperature and also used to refill the geyser when very hot water is drawn from it, to reduce the wastage of water from RO water purifier by storing it in the auxiliary water storage tank which can be further used in household works, and improving the overall efficiency of the system.

In an exemplary embodiment, the present invention provides a highly efficient and economical system for heating and cooling of water and its management. The system is capable to supply warm or cold water suitable for household works during cold or hot weather respectively by using of minimum energy and intelligently detecting the weather condition and clock time for storing water in the auxiliary water storage tank from the outer water storage tank and/or waste water from RO water purifier(s).

The present invention gives several advantages over the traditional water heating systems or methods including, reducing the temperature difference between the initial and desired temperature of water results in reduction of the energy consumed by water heater, utilizing the waste water from RO water purifiers by storing it in the auxiliary water storage tank directly or through hard water softening cartridge for household works. The system is capable of reducing the wastage of energy and water with the help of the auxiliary water storage tank and artificial intelligence.

The present invention solves the problems occurring in conventional water heating systems and RO water purifier systems, like consumption of excess energy in heating water, rapid reduction in temperature of very hot water inside the geyser due to mixing of very cold water directly from the outer water storage tank, limitation of warm water supply, wastage of water in the water purification process of RO water purifiers.

Referring to FIG. 1 which depicts the block diagram of the system 100 of energy efficient hot and cold water management (hereinafter referred to as "system 100"), according to an exemplary embodiment of the present invention. The system 100 comprises: a control unit 101 for controlling the functioning of the system 100; at least a water storage tank 102 with at least a water level sensor (not shown), at least a heating element 1021 and at least a temperature sensor 1022 capable of storing very hot water at controlled temperature; at least an auxiliary water storage tank 103 with at least a water level sensor (not shown), at least a temperature sensor 1032 used to store water from an outer water storage tank 113 which contains water at an atmospheric temperature; a power supply with power backup unit 104 for providing basic power for proper functioning of the system 100; at least a water mixer unit 105 having at least a temperature sensor 1051; a user interface unit 1012 for controlling and monitoring different parameters including temperature, water level, opening and closing of valves 108 and 109. The system 100 may also comprises switches 106 and 107 adapted to switch ON/OFF the heating element and a cooling element respectively. As shown in the FIG. 1, a grid 110, a grid or other energy source 111, a system user 112 (also referred to as "external world 112"), the outer water storage tank 113 are connected to the system 100. The user interface unit 1012 intelligently monitors and shares different parameters like voltage, current, temperature, water level etc., to the system user directly or remotely.

According to an exemplary embodiment of the present invention, each component of the system 100 established a direct/in-direct communication with the control unit 101 and the user interface unit 1012 for transmission of data between them. The power supply with power backup unit 104 provides the basic power for all components/blocks of the system 100 for its proper functioning.

The control unit 101 is responsible for all operations performed by the system 100 including opening and closing of the valves 108 and 109 to allow the storage of water from the outer water storage tank 113 into the auxiliary water storage tank 103 and the water storage tank 102, turn ON/OFF the switches 106 and 107, temperature control or water conditioning of the water as per user predefined temperature. The control unit 101 is configured to receive the real time (or time of the day) and weather data through the internet (or web).

The water storage tank 102 may comprise of with at least a water level sensor (not shown), at least an in-built heating element 1021 and at least a temperature sensor 1022. The water storage tank 102 is used to store very hot water at controlled temperature which is further used to mix with cold water in the water mixer unit 105.

The auxiliary water storage tank 103 may be used to store water from the outer water storage tank 113 depending on weather conditions and clock time. This stored water is then used to refill the water storage tank 102 when very hot water is drawn from it and also to mix with very hot water in the water mixer unit 105.

The Power Supply with Power Backup unit 104 provides the basic power supply to the control unit 101 and other components of the system 100 to perform its operations.

At least a hard water softening cartridge 1011 is used to remove the hardness of water coming from the outer water storage tank 113 before storing it in the auxiliary water storage tank 103.

The water mixer unit 105 has two inlets, one for very hot water from water storage tank 102 and the other for cold water from the auxiliary water storage tank 103. The mixing of very hot water and cold water is done either manually through the system user or automatically through the control unit 101.

The grid 110 is a basic power source for the power supply with power backup unit 104 and the cooling elements 1031 and 1023. The grid or other energy source 111 provides energy for heating water which can be in the form of electricity, fossil fuels, natural gas, LPG, solar energy or any other energy sources. The system user 112 may control and monitor different parameters like temperature, water level, opening/closing of the valves 108 and 109 with the help of external devices like mobile, computer, TAB, PDA, etc., or through on device user interface unit 1012. The system user 112 may receive the status of the system 100 on their smart phone, computer etc. The outer water storage tank 113 may contain water at atmospheric temperature.

Figure 2:
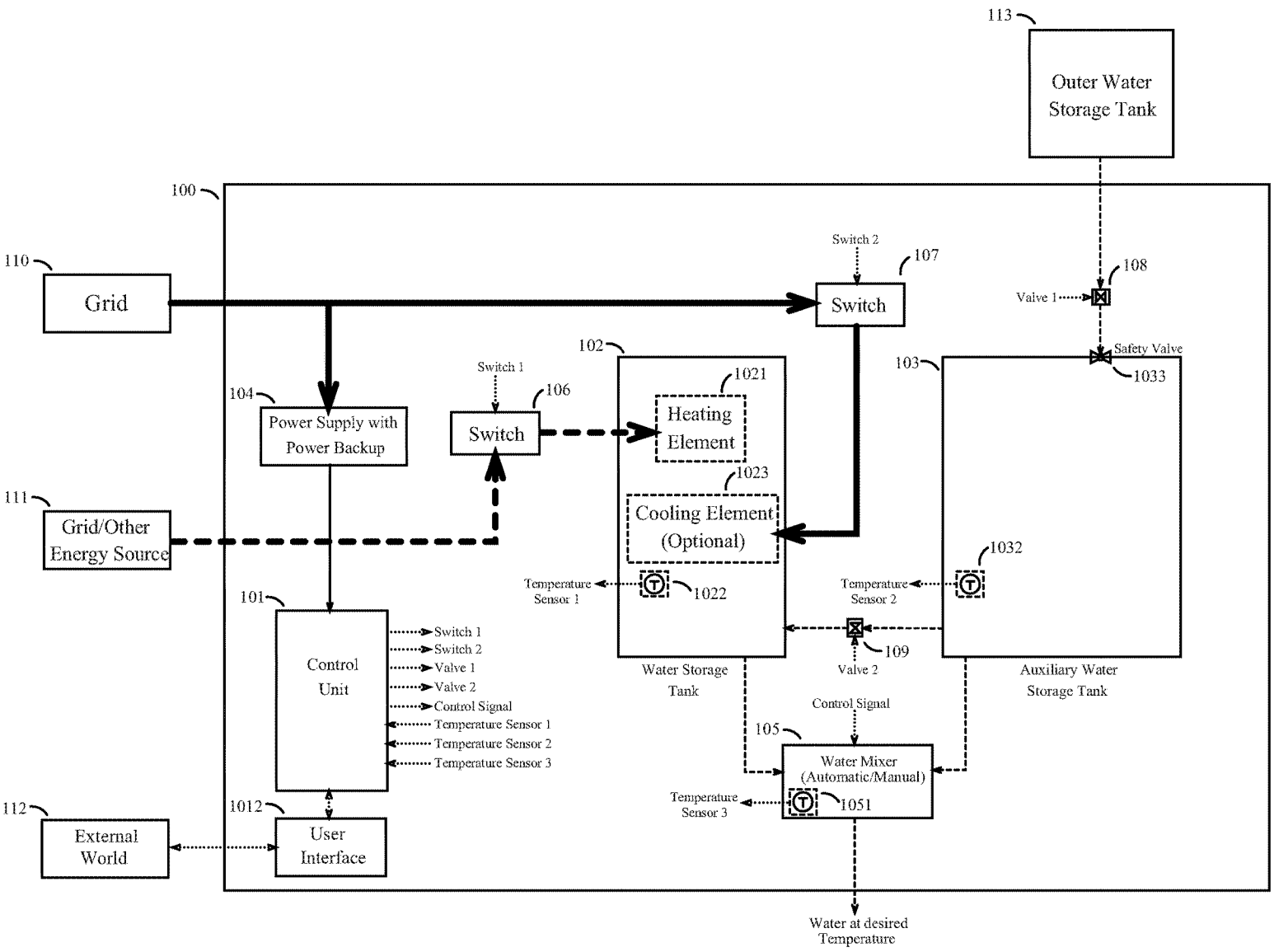
FIG. 2 is a block diagram of the system of energy efficient hot and cold water management, wherein the cooling element may be placed in water storage tank instead of auxiliary water storage tank, according to an exemplary embodiment of the present invention.

Referring to FIG. 2 which is a block diagram of the system 100, wherein the cooling element 1023 may be placed in water storage tank 102 instead of the auxiliary water storage tank 103, according to an exemplary embodiment of the present invention.

Figure 3:
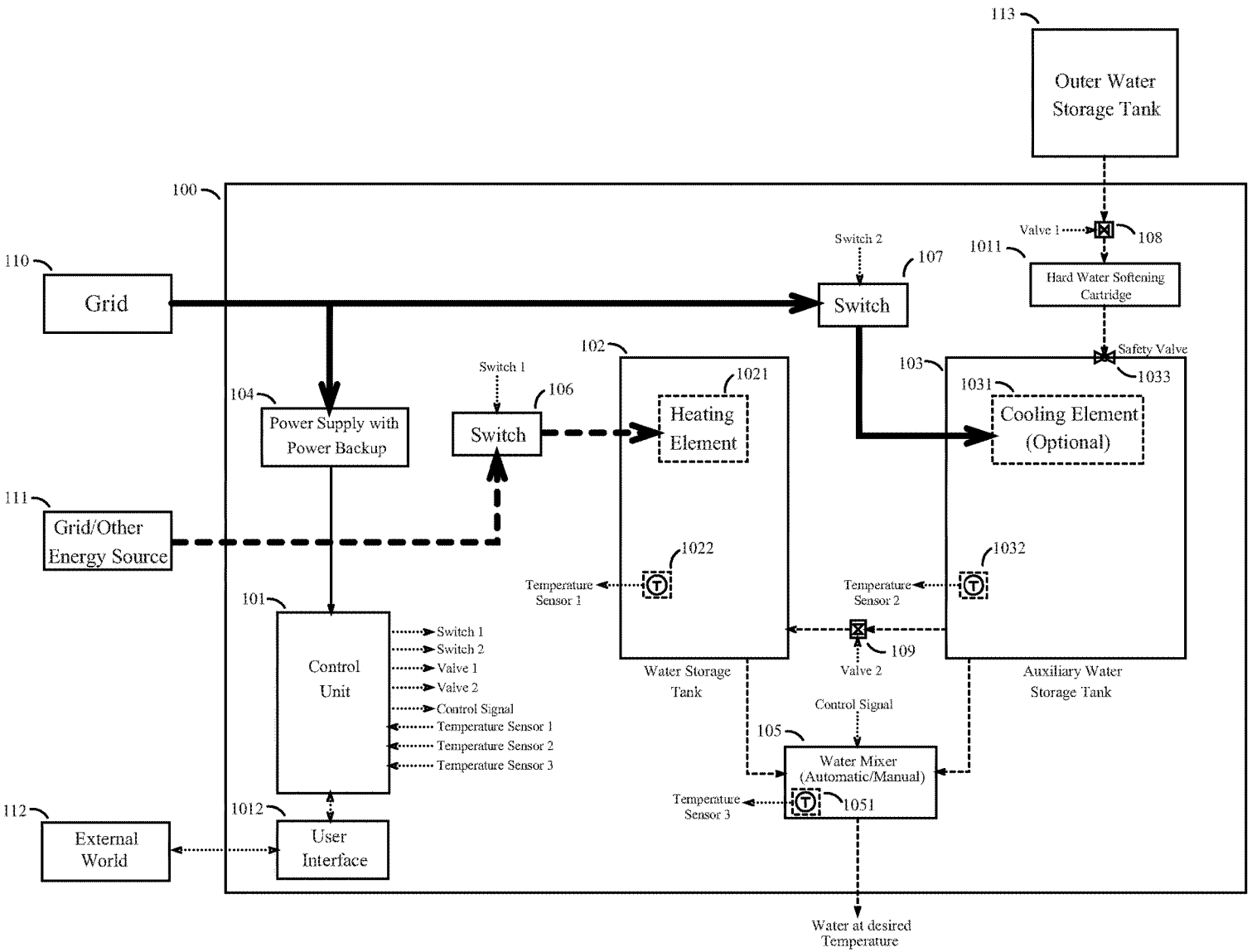
FIG. 3 is a block diagram of the system of energy efficient hot and cold water management, wherein the hard water softening cartridge may be used to remove the hardness of water before storing it in auxiliary water storage tank, according to an exemplary embodiment of the present invention.

Referring to FIG. 3 which is a block diagram of the system 100, wherein the hard water softening cartridge 1011 may be used to remove the hardness of water before storing it in auxiliary water storage tank 103, according to one embodiment of the present invention. The hard water softening cartridge 1011 is adapted to remove the hardness of water coming from outer water storage tank 113 before storing it in the auxiliary water storage tank 103.

Figure 4:
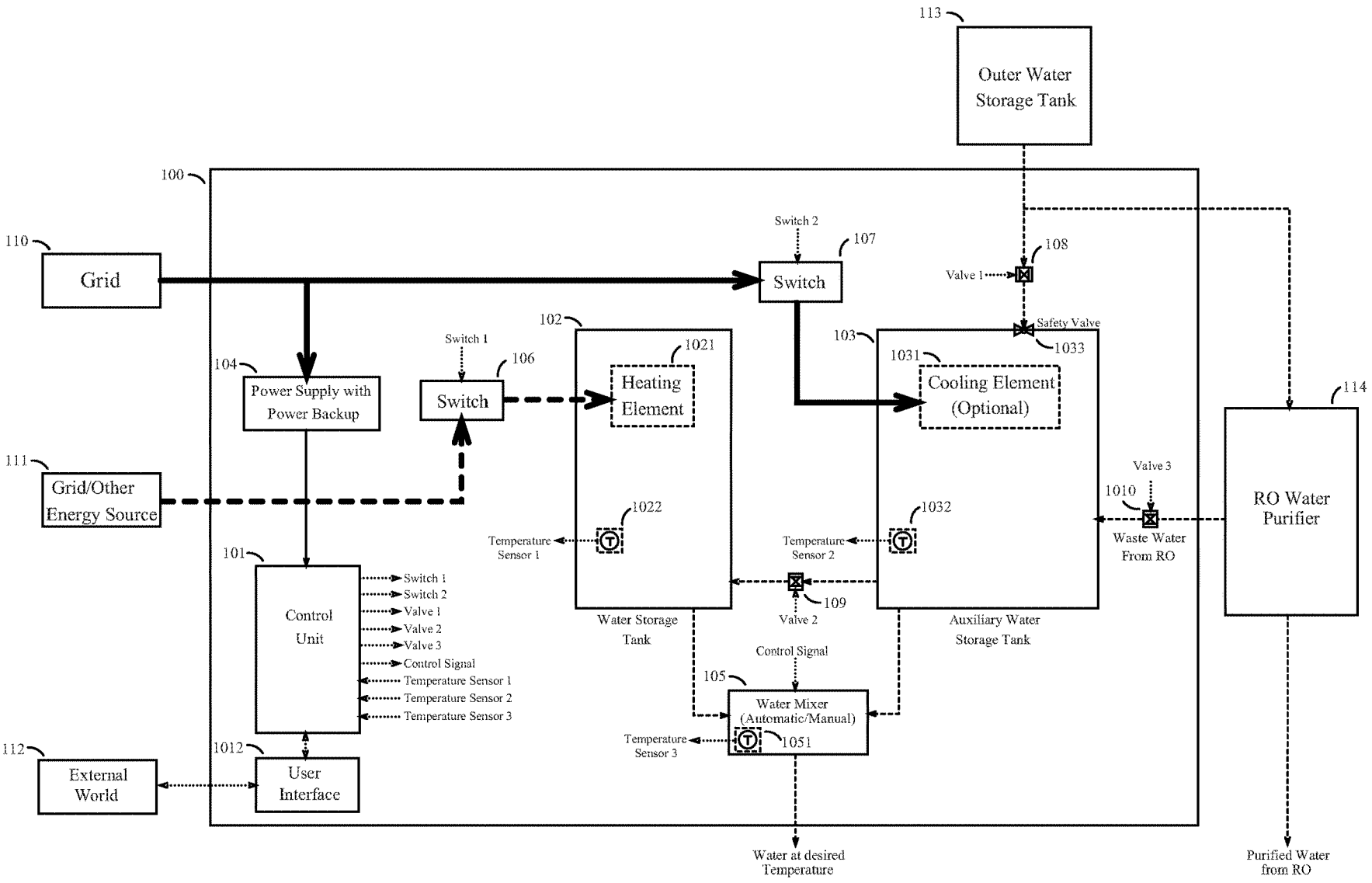
FIG. 4 is a block diagram of the system of energy efficient hot and cold water management, wherein the waste water from a RO water purifiers may also be stored in auxiliary water storage tank, according to an exemplary embodiment of the present invention.

Referring to FIG. 4 which is a block diagram of the system 100, wherein the waste water from a RO water purifier 114 may also be stored in auxiliary water storage tank 103, according to an exemplary embodiment of the present invention. The system 100 allows the storage of waste water from RO water purifier 114 in the auxiliary water storage tank 103 through a valve 1010, which can be used in household works.

Figure 5:
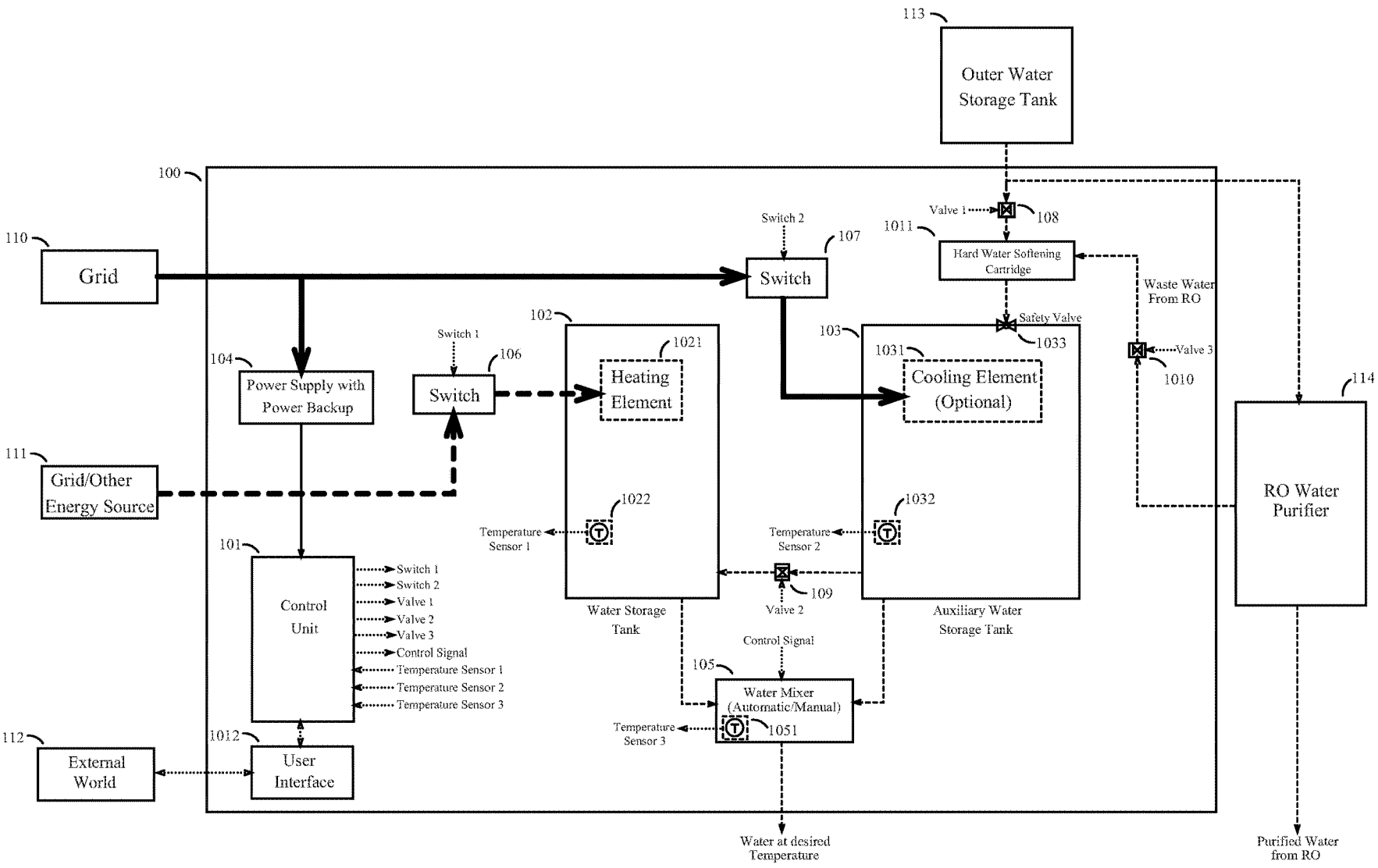
FIG. 5 is a block diagram of the system of energy efficient hot and cold water management, wherein the waste water from the RO water purifiers is passed through hard water softening cartridge before storage in the auxiliary water storage tank, according to an exemplary embodiment of the present invention.

Referring to FIG. 5 which is a block diagram of the system 100, wherein the waste water from the RO water purifiers 114 is passed through the hard water softening cartridge 1011 before storage in the auxiliary water storage tank 103, according to an exemplary embodiment of the present invention.

Figure 6:
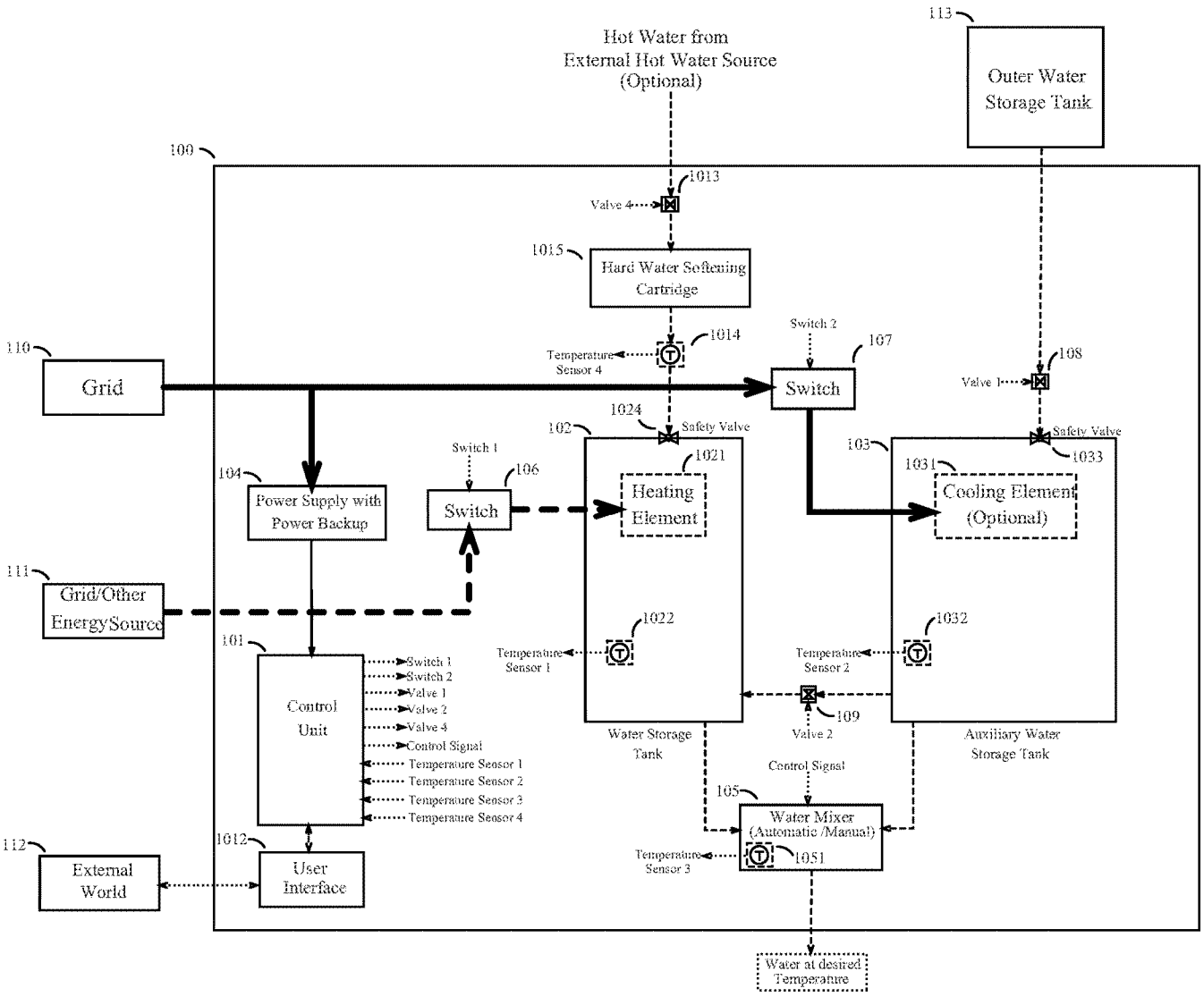
FIG. 6 is a block diagram of the system of energy efficient hot and cold water management, wherein the hot water from an external hot water source may also be used as hot water source in place of heating the cold water in the water storage tank, according to an exemplary embodiment of the present invention.

Referring to FIG. 6 which is a block diagram of the system 100, wherein the hot water from an external hot water source may also be used as a hot water source in place of heating the cold water in the water storage tank 102, according to another exemplary embodiment of the present invention.

According to an exemplary embodiment of the present invention, the system 100 may allow manual and automatic mixing of cold water from the auxiliary water storage tank 103 and very hot water from the water storage tank 102 in the water mixer unit 105 with the help of any of pumps, the valves 108 and 109 and the control unit 101.

According to an exemplary embodiment of the present invention, the system 100 is capable of providing cold water during summers with the help of a cooling element 1031/1023 powered by the grid 110 through the switch 107 according to Real Time Clock (also referred to as "RTC") and weather conditions or as per user requirement. The cooling element 1031/1023 can be placed in auxiliary water storage tank 103 or the water storage tank 102 as shown in FIGS. 1 and 2 respectively.

According to an exemplary embodiment of the present invention, the system 100 is capable of using an external hot water source for hot water in place of heating the cold water (from auxiliary water storage tank 103) in the water storage tank 102 using the heating element 1021. The hot water coming from external hot water source may be further heated in water storage tank 102 if its temperature is below the required temperature of hot water. The temperature of the water storage tank 102 is measured by a temperature sensor 4 and the required temperature of hot water is measured by a temperature sensor 1. If hard water is coming from external hot water source then it may be softened with the help of hard water softening cartridge 1011.

According to one embodiment of the present invention, the system 100 performs its operations using the grid or other energy source 111, the grid 110 and the power supply with power backup unit 104. Firstly, the control unit 101 opens the valves 108 and 109 allowing the storage of water from the outer water storage tank 113 into the auxiliary water storage tank 103 and the water storage tank 102 according to the Real Time Clock and weather conditions or as per user requirement. A safety valve 1033 may be adapted to ensure that the water level in the auxiliary water storage tank 103 does not exceed the safety limit and protections against the valves 108 and 109 failure. When the auxiliary water storage tank 103 and the water storage tank 102 is filled completely, the control unit 101 sends signal to close the valves 108 and 109. When the heating element 1021 is switched ON by the switch 106, water in the water storage tank 102 starts heating up. The temperature sensor 1022 sends a signal to the control unit 101 and the control unit 101 turns OFF the heating element 1021 through the switch 106 as the temperature increases beyond the limit.

When hot water is drawn from the water storage tank 102, the valve 109 allows the flow of water from the auxiliary water storage tank 103 into the water storage tank 102 automatically to refill it. The control unit 101 controls the flow of very hot water from water storage tank 102 and the cold water from auxiliary water storage tank 103 into the water mixer unit 105 through the valves 108, 109 and/or the pumps to achieve desired temperature of water using temperature sensors 1022 and 1032. A temperature sensor unit 1051 sends signal to the control unit 101 when desired temperature is achieved which further sends data to the user interface unit 1012 regarding the same. For example, if the system 100 is working according to the Real Time Clock and weather conditions, then during winters, the control unit 101 may open the valve 108 at the end of the day as water will be warm at the end of the day as compared to that at night, allowing the storage of water from the outer water storage tank 113 into the auxiliary water storage tank 103. The heating element 1021 may be switched ON/OFF automatically according to the user. The control unit 101 controls the switches 106 and 107 and valves 108 and 109 according to the Real Time Clock.

During summers, the control unit 101 will open the valve 108 in the morning time as the atmospheric temperature is cooler at night as compared to day time. This controlling of valves 108 and 109 and the switches 106 and 107 may also be done manually by the user as per requirement.

According to exemplary embodiments of the present invention, the auxiliary water storage tank 103 is used to store water coming from the outer storage tank 113 depending on weather conditions and clock time, i.e., the water is stored at the starting of morning and evening during hot and cold weather respectively. During cold weather the temperature of water stored in auxiliary water storage tank 103 is generally higher than the temperature of water stored in outer water storage tank 113 because it was stored in the evening. During cold weather the water stored in auxiliary water storage tank 103 is used instead of direct very cold water from outer water storage tank 113 for mixing with very hot water and to refill the geyser when hot water is drawn from it. During hot weather the temperature of water stored in auxiliary water storage tank 103 is generally less than the temperature of water stored in outer water storage tank 113 because it was stored in the morning. The mixing of very hot water from geyser and cold water from auxiliary water tank 103 is done in water mixer unit 105 which may be automatically controlled by control unit 101 or manually. The control unit 101 is capable to control the temperature of water as per system user 112 requirement with the help of water mixer (automatic) unit 105, temperature sensors, valves and switches.

The auxiliary water storage tank 103 is capable of storing water discarded by RO water purifier which may be used in household works. The auxiliary water storage tank 103 is also capable of storing water discarded by RO water purifier after removing its hardness through hard water softening cartridge 1011. The hot water from external hot water source may be hard water which is further softened through hard water softening cartridge 1011. The cooling elements 1023, 1031 may be placed in geyser or auxiliary water storage tank 103 to get cold water during hot weather. The hot water from an external hot water source may be used as an optional source of hot water and the heating element switched ON/OFF depending on temperature of the external hot water source to achieve the desired temperature of water at output. The control unit 101 capable of receiving weather information and time of the day through the internet, detecting the weather condition and time of the day to intelligently store water in the auxiliary water storage tank 103, storing the water from an outer water storage tank 113 into the auxiliary water storage tank 103 in the evening during winter and in the morning during summer.

Although a particular exemplary embodiment of the invention has been disclosed in detail for illustrative purposes, it will be recognized by those skilled in the art that variations or modifications of the disclosed invention, including the rearrangement in the configurations of the parts, changes in sizes and dimensions, variances in terms of shape may be possible. Accordingly, the invention is intended to embrace all such alternatives, modifications and variations as may fall within the spirit and scope of the present invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the present invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

We claim:

1. A system (100) of energy efficient hot and cold water management by dynamically controlling the functioning of the system (100) for minimizing the energy consumption by heating and cooling water according to requirements and atmospheric temperature conditions and providing on-device and remote monitoring and controlling of the system (100), comprising: at least a water storage tank (102) with at least one of a water level sensor; at least a heating element (1021); at least one cooling element (1023) disposed in the water storage tank; at least a temperature sensor (1022) or any combination thereof; at least one outer water storage tank (113) exposed to ambient conditions exterior to a household; at least an auxiliary water storage tank (103) with at least one of a water level sensor and a temperature sensor (1032); at least a water mixer unit (105) having at least a temperature sensor (1051) and two inlets for mixing of very hot water and cold water; a reverse osmosis, abbreviated RO, water purifier (114) supplying waste water to the auxiliary water storage tank (103); a user interface unit (1012) for controlling and monitoring different parameters including temperature, water level, opening and closing of valves (108) and (109); and a power supply with a power backup unit (104) for providing basic power for proper functioning of the system (100); wherein the water storage tank (102) is adapted to store very hot water at a controlled temperature which is further used to mix with cold water in the water mixer unit (105); wherein the outer water storage tank (113) contains water at an atmospheric temperature and the auxiliary storage tank (103) is adapted to store water from the outer water storage tank (113) depending on weather conditions and clock time; wherein the heating element (1021) is adapted to heat hot water coming in the water storage tank (102) from an external hot water source if temperature of the hot water coming in the water storage tank (102) is below a required temperature of the hot water, wherein the temperature sensor (1022) aids in controlling the temperature of the hot water; wherein the system (100) is capable of detecting the weather condition and time of the day to intelligently store water in the auxiliary water storage Tank (103), transferring the water from the outer water storage tank (113) into the auxiliary water storage tank (103) in the evening during winter and in the morning during summer.

2. The system (100) of claim 1, wherein the auxiliary water storage tank (103) further comprises; at least one of a cooling element (1031), (1023) and a safety valve (1033); wherein the cooling element (1031), (1023) is powered by a grid (110) through a cooling switch (107) according to a Real Time Clock and weather conditions or as per user requirement, wherein the safety valve (1033) ensures that the water level in the auxiliary water storage tank (103) does not exceed a safety limit and protections against failure of the valves (108) and (109).

3. The system (100) of claim 1 being capable of receiving weather information and time of the day through the internet.

4. The system (100) of claim 1, wherein at least a hard water softening cartridge (1011) is used to remove the hardness of water coming from the outer water storage tank (113) before storing it in the auxiliary water storage tank (103).

5. The system (100) of claim 1, wherein the water mixer unit (105) includes two inlets for very hot water from water storage tank (102) and cold water from the auxiliary water storage tank (103).

6. The system (100) of claim 1, wherein the grid (110) is a basic power source for the power supply with power backup (104) and a cooling element (1013).

7. The system (100) of claim 1, wherein the grid or other energy source (111) includes electricity, fossil fuels, natural gas, LPG, solar energy or any other energy sources to provides energy for heating water.

8. The system (100) of claim 1, wherein a waste water from a RO water purifier (114) is passed through the hard water softening cartridge (1011) before storage in the auxiliary water storage tank (103) through a valve (1010).

9. The system (100) of claim 1, wherein the hot water from the external hot water source may be used as a hot water source in place of heating the cold water in the water storage tank (102).

10. The system (100) of claim 1, wherein manual and automatic mixing of cold water from the auxiliary water storage tank (103) and very hot water from the water storage tank (102) in the water mixer (105) is performed with the help of any of pumps, the valves (108) and (109) and the control unit (101).

11. The system (100) of claim 1, wherein at least one of the cooling elements (1031) and (1023) is capable of providing cold water during summers.

* * * * *